US009856043B2

(12) United States Patent
Sachs et al.

(10) Patent No.: US 9,856,043 B2
(45) Date of Patent: Jan. 2, 2018

(54) METHOD AND DEVICE FOR HANDLING BAGS COMBINED INTO BUNDLES

(71) Applicant: Focke & Co. (GmbH & Co. KG), Verden (DE)

(72) Inventors: Frank Sachs, Saterland (DE); Bjorn Brandhorst, Horstel (DE); Jorg Schnecke, Castrop-Rauxel (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 634 days.

(21) Appl. No.: 14/359,132

(22) PCT Filed: Nov. 16, 2012

(86) PCT No.: PCT/EP2012/004775

§ 371 (c)(1),
(2) Date: May 19, 2014

(87) PCT Pub. No.: WO2013/075807

PCT Pub. Date: May 30, 2013

(65) Prior Publication Data

US 2014/0352262 A1 Dec. 4, 2014

(30) Foreign Application Priority Data

Nov. 22, 2011 (DE) ..... 10 2011 119 041

(51) Int. Cl.
*B65B 43/14* (2006.01)
*B65B 63/02* (2006.01)
(Continued)

(52) U.S. Cl.
CPC ..... *B65B 43/14* (2013.01); *B31B 70/98* (2017.08); *B65B 63/02* (2013.01); *B65H 31/30* (2013.01);
(Continued)

(58) Field of Classification Search
CPC ..... B65B 43/12; B65B 43/14; B65B 43/16; B65B 43/44; B65G 9/008; B65G 9/002
(Continued)

(56) References Cited

U.S. PATENT DOCUMENTS 3,033,342 A * 5/1962 Kinnicutt, Jr. ..... B65G 47/61 198/431
3,240,356 A * 3/1966 Hill ..... B21C 47/24 198/418
(Continued)

FOREIGN PATENT DOCUMENTS

CN 101875407 A 11/2010
DE 3704663 A1 4/1990
(Continued)

OTHER PUBLICATIONS

State Intellectual Property Office of the People's Republic of China, Notification of the First Office Action (in a related application), dated Feb. 6, 2015.
(Continued)

*Primary Examiner* — Thanh Truong
*Assistant Examiner* — Dariush Seif
(74) *Attorney, Agent, or Firm* — Laurence P. Colton; Smith Temple Blaha LLC

(57) ABSTRACT

A method for handling bags (10), in particular wicketed bags, combined into bundles (13) and for feeding the bags (10) to a packaging machine (11), and a corresponding apparatus. In the method and apparatus, the bags (10) are supplied in a plurality of bundles (13) in a magazine (14) arranged upstream of the packaging machine (11); the bundles (13) are arranged on bag carriers (15) in each case such that the bag carriers (15) extend through suspension holes (12) of the bags (10); the bag carriers (15) with the bags (10) located thereon are fed from the magazine (14) to
(Continued)

the packaging machine (11); and the bundles (13) are transferred from the bag carriers (15) directly to appropriately arranged receiving pins (28) of a cyclically driven conveying device (29) of the packaging machine (11) and are then filled in the packaging machine (11).

5 Claims, 11 Drawing Sheets

(51) Int. Cl.
*B65H 31/30* (2006.01)
*B31B 70/98* (2017.01)
*B31B 160/10* (2017.01)

(52) U.S. Cl.
CPC .... *B31B 2160/10* (2017.08); *B65H 2301/323* (2013.01); *B65H 2404/3141* (2013.01); *B65H 2701/1212* (2013.01); *B65H 2701/191* (2013.01)

(58) Field of Classification Search
USPC ..... 53/459, 469, 570, 571, 384.1, 284.7, 53/389.1; 198/486.1, 692, 693, 605, 680, 198/418.8, 359; 271/4.01
See application file for complete search history.

(56) References Cited

U.S. PATENT DOCUMENTS 3,440,801 A * 4/1969 Prince ..... B65B 43/14 271/154
3,454,148 A * 7/1969 Harrison ..... B65G 47/61 198/360
3,555,977 A * 1/1971 Saumsiegle ..... B65H 29/46 198/610
3,918,589 A * 11/1975 Nausedas ..... B65D 33/001 206/526
4,037,388 A * 7/1977 Bastasch ..... B65B 57/04 53/572
4,178,659 A * 12/1979 Simonds ..... A22C 21/0053 198/478.1
4,262,803 A * 4/1981 Nausedas ..... B65B 43/00 206/494
4,277,930 A * 7/1981 Nausedas ..... B65B 43/00 53/390
4,519,504 A * 5/1985 Nausedas ..... B65B 25/065 206/449
4,541,226 A * 9/1985 Nausedas ..... B65B 25/065 211/57.1
4,923,064 A * 5/1990 Hannon ..... B65B 25/14 206/554
5,030,191 A 7/1991 Reifenhauser
5,056,202 A * 10/1991 Stiegler ..... B31B 19/00 198/692
5,249,409 A * 10/1993 Jensen ..... B65B 5/045 53/253
5,404,989 A * 4/1995 Veen ..... B65G 47/61 198/465.4
6,419,077 B1 * 7/2002 White ..... A22C 15/002 198/433
6,711,882 B1 * 3/2004 Schneider ..... B31B 19/98 53/241
2002/0112452 A1 * 8/2002 DeSmedt ..... B65B 43/26 53/459
2004/0148912 A1 * 8/2004 Lambrecht ..... B65B 5/105 53/473

FOREIGN PATENT DOCUMENTS

DE 19521852 A1 12/1996
DE 19713334 C1 7/1998
DE 10154307 A1 2/2003
DE 19839144 B4 7/2004
EP 0064272 A2 11/1982
EP 0424718 A1 5/1991
EP 1157815 A2 11/2001

OTHER PUBLICATIONS

Deutsches Patent—Und Markenamt (German Patent and Trademark Office), Rechercheberigcht (Search on parent German Patent Application No. 10 2011 119 041.8), dated Jul. 31, 2013.
PCT/WIPO, International Search Report (on parent PCT patent application PCT/EP2012/004775), dated Mar. 13, 2013.

* cited by examiner

METHOD AND DEVICE FOR HANDLING BAGS COMBINED INTO BUNDLES

STATEMENT OF RELATED APPLICATIONS

This patent application claims the benefit of International Patent Application No. PCT/EP2012/004775 having an International Filing Date of 16 Nov. 2012, which claims the benefit of German Patent Application No. 10 2011 119 041.8 having a filing date of 22 Nov. 2011.

BACKGROUND OF THE INVENTION

Technical Field

The invention relates to a method for handling bags, in particular wicketed bags, combined into bundles and for feeding the bags to a packaging machine. The invention also relates to a corresponding apparatus for handling bags, in particular wicketed bags, combined into bundles and for feeding the bags to a packaging machine.

Prior Art

In particular for packaging hygiene products, such as diapers or sanitary napkins, the products are packaged in so-called wicketed bags. Such bags are distinguished by having, in an upper region, holes for handling the bags.

In practice, bundles of bags are fed manually one after the other, by an operator, to a packaging machine. It is possible here for the bundles to be fitted onto receiving pins of a conveyor of the packaging machine, for example by way of holes in the bags.

A disadvantage of this procedure resides in the fact that, if the bundles are fed manually, the speed of the packaging machine is restricted. This is because the operator can place the bundles in position only during a brief standstill period of the appropriate conveyor. In the case of appropriately high production speeds of the packaging machine, the standstill period of the conveyor is correspondingly short, and therefore the operator quickly reaches the limits of his capabilities.

BRIEF SUMMARY OF THE INVENTION

Taking this as the departure point, it is an object of the invention to provide methods and apparatuses of the type mentioned in the introduction which ensure that the bags are fed correctly even at high production speeds of the packaging machine.

In order to achieve this object, a method according to the invention has the features of:

- the bags to be supplied in a plurality of bundles in a magazine arranged upstream of the packaging machine,
- the bundles to be arranged on bag carriers in each case such that the bag carriers extend through suspension holes in the bags,
- the bag carriers with the bags located thereon to be fed from the magazine to the packaging machine, and
- the bundles to be transferred from the bag carriers directly to appropriately arranged receiving pins of a cyclically driven conveying device of the packaging machine and then to be filled in the packaging machine.

This solution has the advantage that the bundles are fed automatically to the packaging machine. The mechanical feeding operation also makes it possible to realize very short standstill periods in the region of the conveying device. In particular it is possible for the bags to be supplied in the magazine irrespective of the standstill periods of the conveying device.

An alternative solution or an alternative magazine has the features of:

- the bags to be supplied in a plurality of bundles in a carousel-like magazine arranged upstream of the packaging machine,
- the bundles to be arranged on bag holders of the magazine, wherein preferably a plurality of bag holders are arranged in a plane of the magazine, and wherein the magazine also preferably has a plurality of planes with bag holders, and
- the bags on the bag holders of the magazine to be presented one after the other, by appropriate relative movement of the magazine, for transfer to a feed conveyor, which transfers the bags to receiving pins of a cyclically driven conveying device of the packaging machine, in which the bags are then filled.

Further details and advantageous configurations of the method according to the invention can be gathered from the claims and the rest of the description.

A preferred development of the method provides that, prior to being transferred to the receiving pins of the conveying device, the bags are smoothed, preferably such that the bundles on the bag carriers are drawn in a hanging state over a mechanism, in particular a ramp, located in the conveying path of the bags and are smoothed in the process. This makes it readily possible to counteract the formation of folds in the bags.

A preferred embodiment of the invention provides that the bag carriers are arranged such that they can be displaced along guide means, in particular running rails, wherein the guide means are inclined, at least in certain regions, in the direction of the packaging machine, and therefore the bag carriers with the bags are moved by gravitational force along the guide means in the direction of the packaging machine, and in that the bag carriers, at least in the region of the conveying device, are moved along the guide means in the direction of the receiving pins by a conveying mechanism, in particular a driver chain, and are positioned appropriately above said pins in order for the bundles to be transferred. The bag carriers, in the region of the gravitational-force conveying operation, are preferably arranged and/or transported essentially in a close-packed manner, and are then separated and are transported at a distance apart from one another by the conveying mechanism, in particular by drivers of the driver chain.

One special characteristic relates to the transfer of the bundles to the conveying device. Provision is preferably made here for the preferably hook-like bag carriers to have a free end positioned on upper, free ends of the upright receiving pins, wherein the underside of the bags rests on at least one supporting means, in particular two pivoting arms, arranged in the conveying path of the bags, and for the at least one supporting means to be moved out of the region of the bags in order for the bags to be transferred to the receiving pins, preferably by virtue of the pivoting arms being pivoted laterally.

In order to ensure that the bundles are transferred correctly to the receiving pins, provision may be made for preferably the free ends of the bag carriers to be guided, in particular in groove-like recesses of the pivoting arms and/or of the ramp, during the feeding operation to the receiving pins, and for the bag carriers preferably to be rotated gradually here, by abutment against the guides, such that, when the receiving pins are reached, the free ends of the bag carriers are oriented downward and run essentially in alignment with the free ends of the receiving pins.

An apparatus according to the invention for achieving the object mentioned in the introduction has the features of:

- the packaging machine to have arranged upstream of it a magazine for supplying the bags in a plurality of bundles,
- the bundles to be arranged on bag carriers in each case such that the bag carriers extend through suspension holes in the bags,
- it to be possible for the bag carriers with the bags located thereon to be fed from the magazine to the packaging machine, and
- it to be possible for the bundles to be transferred from the bag carriers directly to appropriately arranged receiving pins of a cyclically driven conveying device of the packaging machine in order then to be filled in the packaging machine.

This solution likewise has the advantage that the bundles are fed automatically to the packaging machine. The mechanical feeding operation also makes it possible to realize very short standstill periods in the region of the conveying device. In particular it is possible for the bags to be supplied in the magazine irrespective of the standstill periods of the conveying device.

Here too, an alternative solution or an alternative magazine has the features of:

- the packaging machine has arranged upstream of it a carousel-like magazine for supplying the bags in a plurality of bundles,
- the bundles are arranged on bag holders of the magazine, wherein preferably a plurality of bag holders are arranged in one plane of the magazine, and wherein the magazine also preferably has a plurality of planes with bag holders, and
- the bags on the bag holders of the magazine can be positioned, by appropriate relative movement of the magazine, for transfer to a feed conveyor, wherein the feed conveyor has receiving pins for transferring the bags to a cyclically driven conveying device of the packaging machine, in which the bags are then filled.

Further details and advantageous configurations of the apparatus according to the invention can be gathered from the claims and the rest of the description.

In order to transport the bags, it may preferably be provided that the bag carriers are mounted in a displaceable manner on guide means, wherein the guide means are inclined, at least in certain regions, in the direction of the conveying device such that the bag carriers can be moved by gravitational force with the bags in the direction of the conveying device, and that a separating device for the bag carriers, which are fed essentially in a close-packed manner, is arranged in the region of the guide means, and that, following the separating device, the bag carriers can be fed to the receiving pins individually by means of a conveying mechanism.

The bag carriers can be fed to the packaging machine such that the conveying device has a driver belt for transporting the bundles preferably in a transverse direction in particular in a horizontal plane, wherein the driver belt has spaced-apart receiving pins for engaging in the suspension holes in the bags, and wherein at least one supporting means, in particular two pivoting arms, is/are arranged in the conveying path of the bundles, above the receiving pins, the bundles resting on the supporting means prior to being transferred to the receiving pins and it being possible for the supporting means, following the feeding operation of a bundle, to be moved out of the region of the receiving pins in order for the bundles to be transferred to the receiving pins.

A preferred embodiment of the invention may provide that each bundle is retained preferably by two bag carriers, which engage in corresponding receiving holes in the bags, wherein the bag carrier or carriers is/are arranged on a common spindle which can be displaced along the guide means via rollers, wherein the bag carriers preferably have a hook-like configuration and a free end for receiving the bags.

A further special characteristic may reside in that the free ends of the bag carriers and corresponding free ends of the receiving pins are intended for form-fitting engagement in relation to one another, in particular such that the free ends of the bag carriers have an end-side recess in which the free ends of the receiving pins can engage, wherein the receiving pins preferably have a cross section which decreases in the direction of the free ends, in order to engage in the end-side recess. This makes it possible to ensure that the bags are transferred correctly. In particular it is the case that the bags, when dropping onto the receiving pins, are not obstructed by a problematic edge or a corresponding transition between the bag carriers and the receiving pins.

A further special characteristic relates to means for orienting the bag carriers, in particular pins for engaging in a guide (track) for raising the bag carriers.

BRIEF DESCRIPTION OF THE DRAWINGS

Two preferred exemplary embodiments of the invention will be explained hereinbelow with reference to the drawing, in which.

DETAILED DESCRIPTION OF PREFERRED EMBODIMENTS

Figure 1:
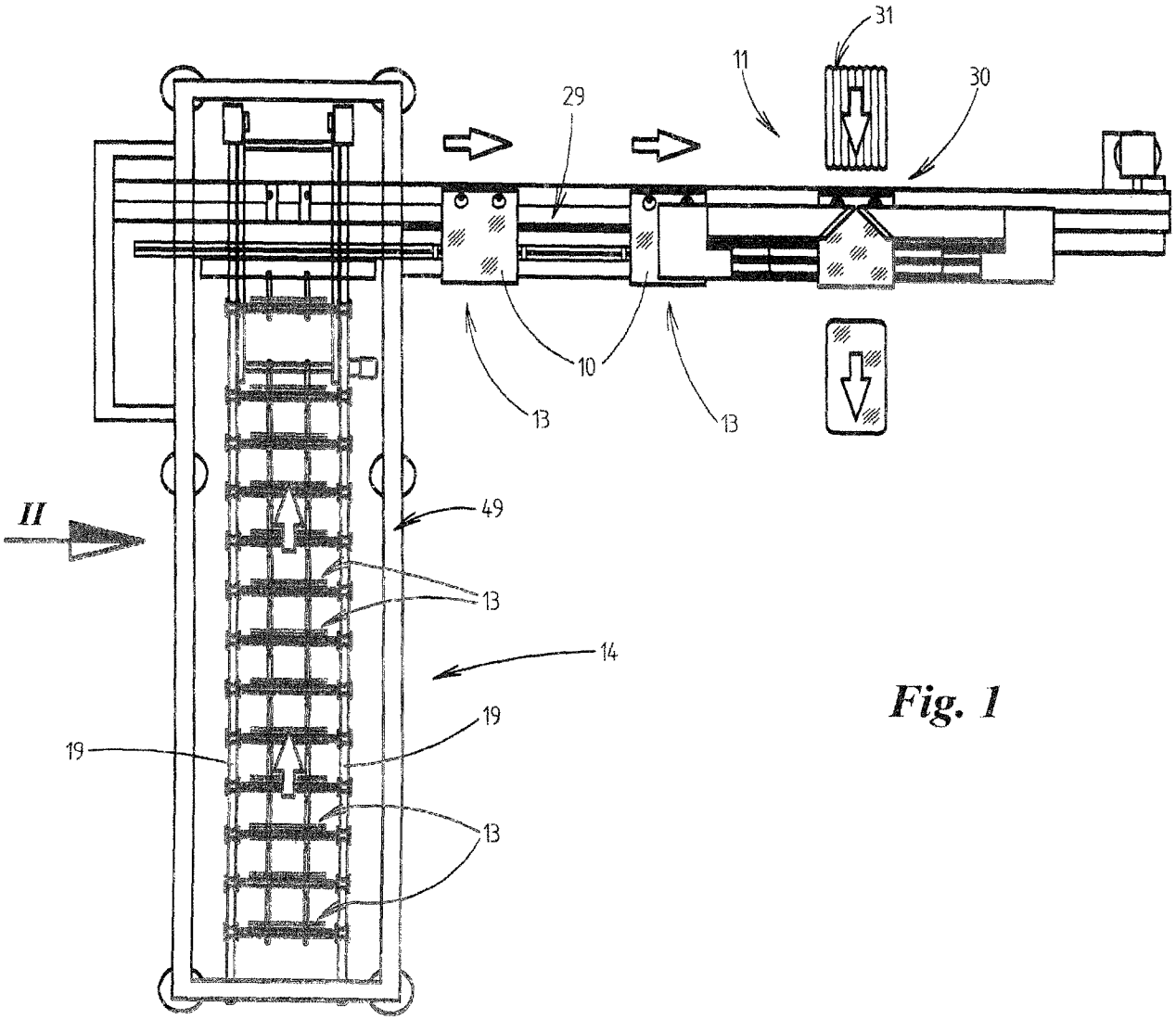
FIG. 1 shows a plan view of a packaging machine with an upstream magazine for bags (first exemplary embodiment)

The exemplary embodiments of the invention which are shown in the figures relate to the handling of bags 10 in conjunction with feeding to a packaging machine 11.

The bags 10, in the present case, are so-called wicketed bags. A characteristic feature of these bags 10 is constituted by suspension holes 12 in the region of an upper periphery of the bags 10. Such bags 10 are used preferably for packaging hygiene products. It is also possible, however, to use the bags 10 in other areas, for example for packaging bread (for toasting).

The bags 10 are formed from a packaging material. Use is made, in particular, of sheet-like packaging materials, for example polyethylene sheets or polypropylene sheets.

The bags 10 are processed in groups, with the bags 10 being combined into bundles 13. Each bundle 13 comprises a plurality of bags 10, for example five bags, ten bags or the like. Within the bundle 13, the bags 10 butt against one another in a flat state in the form of a regular stack.

The bundles 13 are supplied in a magazine 14 and fed automatically to the packaging machine 11. In specific terms:

In the first exemplary embodiment according to FIGS. 1 to 13, the bundles 13 are supplied on so-called bag carriers 15, which grip through the suspension holes 12 of the bags 10 and on which the bags 10 are transported in a hanging state.

In the present case, the bag carriers 15 have a hook-like configuration with a free end 16, which is guided through the suspension holes 12 in order to accommodate the bags 10. It is, of course, possible, in principle, for the bag carriers 15 to be configured in some other way. Reference is also made here to the second exemplary embodiment.

In the present case, each bag 10 has two spaced-apart suspension holes 12. Accordingly, the bags 10 are retained by two bag carriers 15, which are spaced apart from one another by a corresponding distance. It is conceivable for the bags 10 also to have a smaller or larger number of suspension holes 12, and therefore the number of bag carriers 15 can vary correspondingly. It is also conceivable to have specifically shaped suspension holes 12 with correspondingly adapted cross sections for the bag carriers 15, and therefore, if use is made of just one bag carrier 15, it is possible to avoid the situation where the bags 10 swing laterally. Accordingly, the number of bag holes 10 and configuration thereof are not of critical importance for the present invention.

In the present exemplary embodiment, use is made of merely, by way of example, two bag carriers 15 for receiving a bundle 13. The two bag carriers 15 are spaced apart from one another on a spindle 17, which is mounted such that it can be displaced on two running rails 19, in the form of guide means, via lateral rollers 18. The rollers 18, spindle 17 and the bag carriers 15 are part of a carriage 20, which is arranged in a displaceable manner on the guide means.

The two running rails 19 are spaced apart laterally from the conveying path of the bundles 13. In the present case, the running rails 19 have a curved abutment surface for the rollers 18. Correspondingly, the rollers 18 are of convex design, and therefore the rollers 18 are guided along the running rails 19. Of course, it is also possible to provide other measures for orienting and guiding the spindle 17 transversely to the transporting direction of the bags 10.

The bundles 13 can be supplied in the magazine 14 by an operator hanging a group of bags 10 on the bag carriers 15 and then positioning the carriage 20 on the guide rails 19.

As an alternative, it is conceivable for bags 10 which are already hanging on the bag carriers 15 to be delivered to the magazine 14, for example by an (external) delivery means.

In a first portion of the conveying route of the bundles 13, the feeding operation in the direction of the packaging machine 11 takes place (exclusively) by gravitational force. For this purpose, the running rails 19 are inclined downward in the direction of the packaging machine 11, and therefore the carriages 20 roll in the direction of the packaging machine 11.

Said first portion of the conveying route is bounded by a separating device 21. Upstream of the separating device 21, the carriages 20 are accumulated and/or transported in a close-packed manner. Following the separating device 21, the carriages 20, in a second portion of the conveying route, are grouped individually by a conveying mechanism and transported in the direction of the packaging machine 11. In specific terms:

The separating device 21 is designed in the manner of a transfer station, having two retaining means 22, 23 for the carriages 20. The two retaining means 22, 23 can be moved independently of one another, in the present case in the vertical direction, into, and out of, the conveying path of the carriages 20. The carriages 20 are accumulated downstream of the first retaining means 22. By virtue of the first retaining means 22 being raised and lowered, a single carriage 20 is allowed through and strikes against the lowered retaining means 23. There, the carriage 20 is then gripped in a precise position by a conveying device 29, while at the same time the second retaining means 23 is raised and the carriage 20 is transported in the direction of the packaging machine.

The retaining means 22, 23 are raised and lowered, for example, by appropriate pneumatic cylinders or other suitable mechanisms. Of course, the retaining means 22, 23 need not necessarily be movable in the vertical direction, and correspondingly suitable separating apparatuses of different types or designs are likewise conceivable here.

The aforementioned conveying mechanism for transporting the separated carriages 20 further is formed, in the present case, by two cyclically driven driver chains 26. The driver chains 26 are guided in each case over deflecting rollers 27, wherein a conveying strand runs parallel to the running rail 19 in order to feed the carriages 20 in the direction of the packaging machine 11. The conveying strand is arranged at a distance above the running rails 19, and therefore the drivers 25, which project outward in relation to the driver chains 26, can each grip a carriage 20 and transport the same along the rest of the conveying route.

Figure 3:
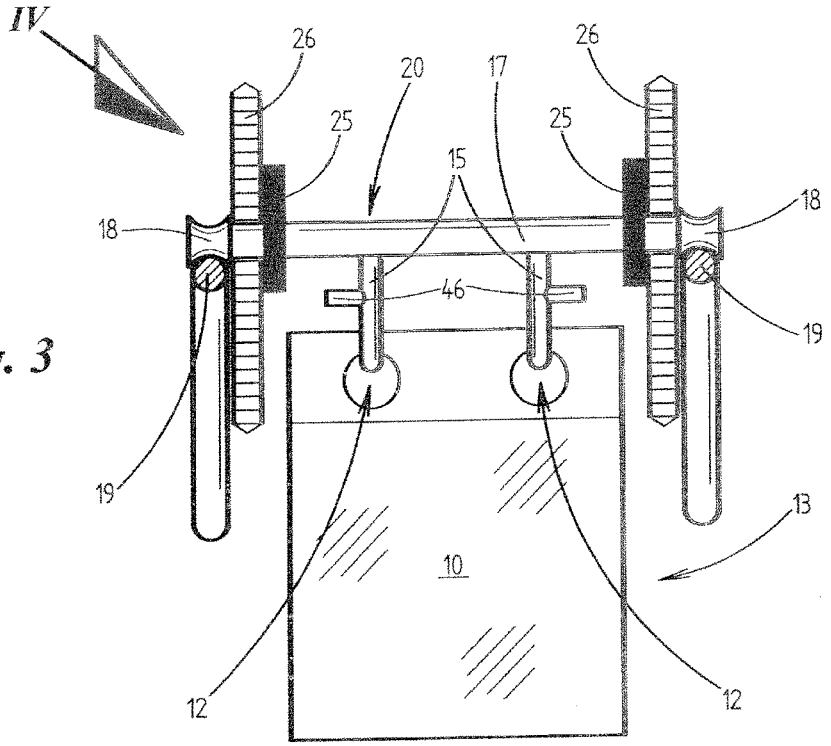
FIG. 3 shows a vertical section taken through part of the apparatus along section line III-III in FIG. 2.
Figure 4:
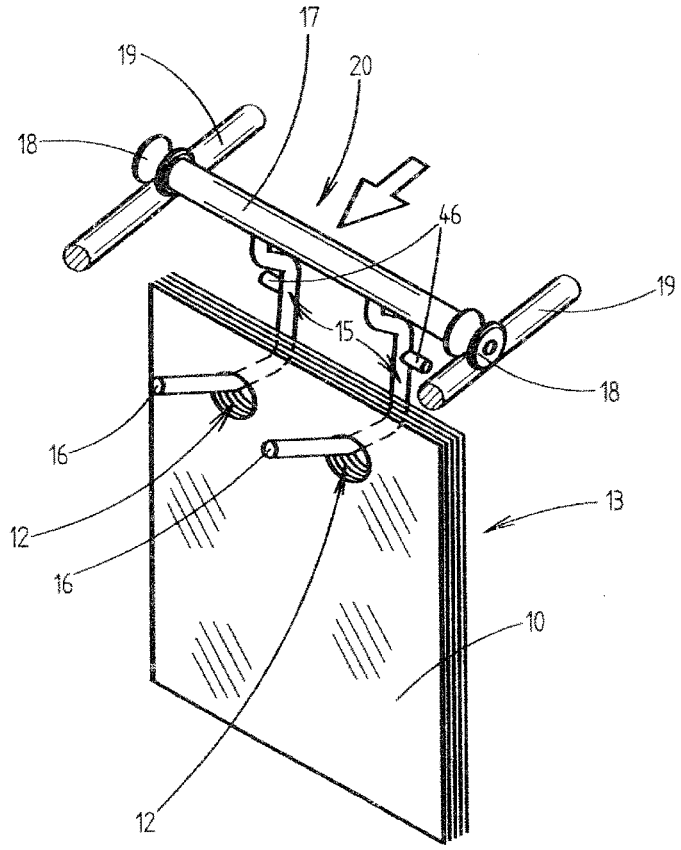
FIG. 4 shows a three-dimensional illustration of the region of the vertical section according to FIG. 3, FIGS. 5 and 6 show a detail of the apparatus in the region V-VI in FIG. 2, FIGS. 7 to 10 show a detail of the apparatus in the region VII in FIG. 6 during different phases of the feeding operation of the bags.
Figure 5:
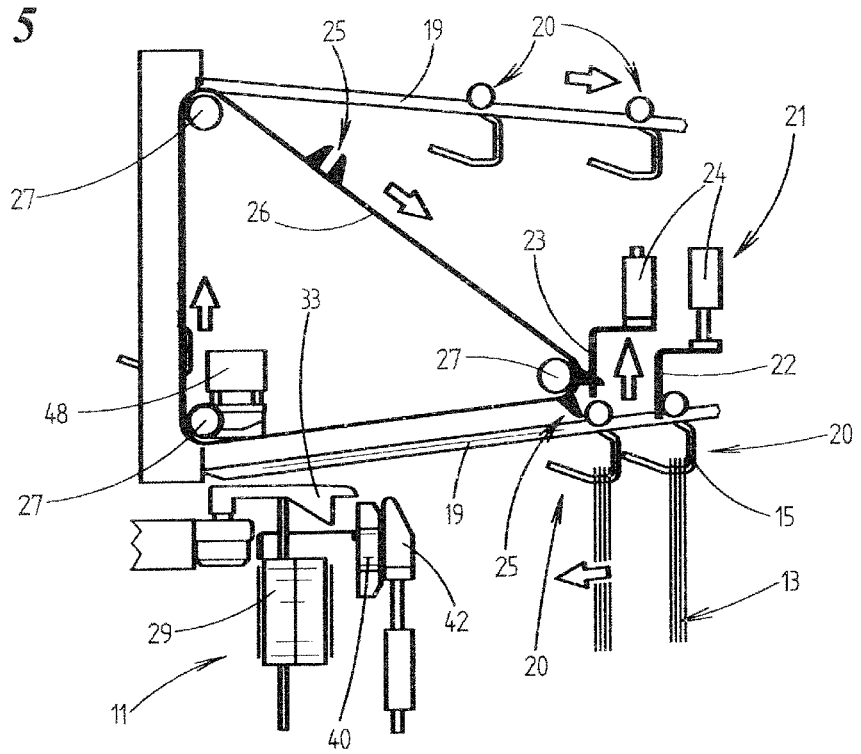
Figure 6:
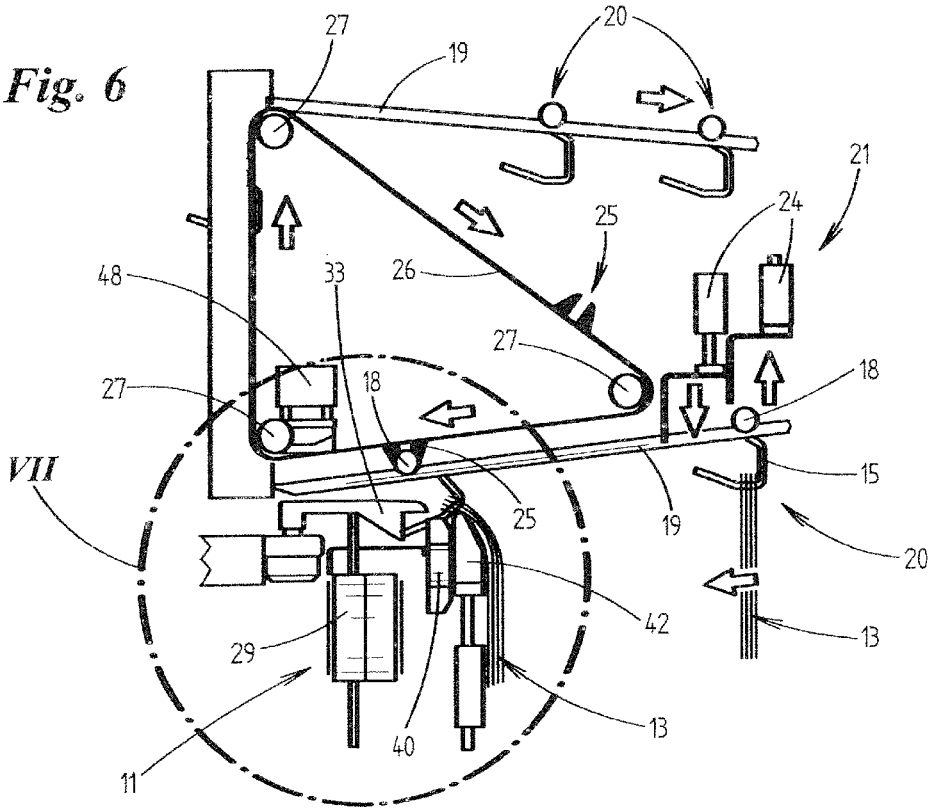

It is possible for the drivers 25 either to have a recess for engaging with a spindle 17 of a carriage 20 or to be arranged in the form of an appropriately spaced-apart pair of drivers, and therefore the spindle 17 can be gripped or clamped in, and transported, between the two drivers of the pair of drivers. As FIG. 3 shows, the driver chains 26 are arranged in each case on the inside of the running rails 19, wherein the drivers 25, in turn, are arranged laterally on the inside of the driver chains 26 and grip the spindle 17 of the carriage 20 at the greatest possible distance apart from one another.

Of course, as an alternative to the driver chains 26, use can also be made of other (endless) conveyors.

The carriages 20 or the bundles 13 are then fed to the packaging machine 11 for further processing. In the present case, this takes place by virtue of the bundles 13 being fed to a conveying device 29, which feeds the bundles 13 to the packaging operation. The conveying device 29 may be part of the packaging machine 11 or a mechanism which is arranged upstream of the packaging machine.

The conveying device 29 has receiving pins 28 which are provided in accordance with the number and arrangement of the suspension holes 12. In the present case, the receiving pins 28 are arranged in pairs, wherein the distance between the receiving pins 28 corresponds to the distance between the suspension holes 12 of the bags 10. A plurality of such pairs of receiving pins are spaced apart from one another on the circumference of an endless conveyor, preferably of an endless belt conveyor, in relation to which the receiving pins 28 project in the manner of drivers. The bundles 13 are fed here in the region of an upper strand of the belt conveyor. More specifically, the bundles 13 are fed to a pair of receiving pins 28 during a brief standstill period of the cyclically driven conveying device 29.

With the aid of the conveying device 29, the bundles 13 are transported on the running rails 19, transversely to the conveying direction, and are moved into the region of a filling station 30 of the packaging machine 11. There, in a manner which is known from the prior art, products 31, for example diapers, are packaged into the bags 10 and are transported away on the conveying device 29 transversely to the conveying direction of the bundles 13.

In the region of a feeding station 32 of the conveying device 29, the bundles 13 are transferred from the bag carriers 15 directly to the receiving pins 28 of the conveying device 29. This takes place by the free ends of the bag carriers 15 being arranged in alignment with the free ends of the receiving pins 28, and therefore the bags 10 can drop onto the receiving pins 28. In order for it to be possible for this transfer to take place in ordered fashion, the following further means and measures are provided:

Pivoting arms 33 are provided in the region of the feeding station 32, it being possible for said pivoting arms to be pivoted about a vertical spindle 34 by means of a pneumatic rotary cylinder 35. The pivoting arms 33 are designed on the upper side in the form of plate-like members in order to form a bearing surface for a bundle 13 in the feeding station 32.

During the feeding operation of the bundles 13, the carriages 20 are conveyed by the drivers 25 until the free ends 16 of the bag carriers 15 are located on the receiving pins 28. The pivoting arms 33 are then pivoted away laterally, and therefore the bundle 13 is accommodated by the receiving pins 28.

Figure 7:
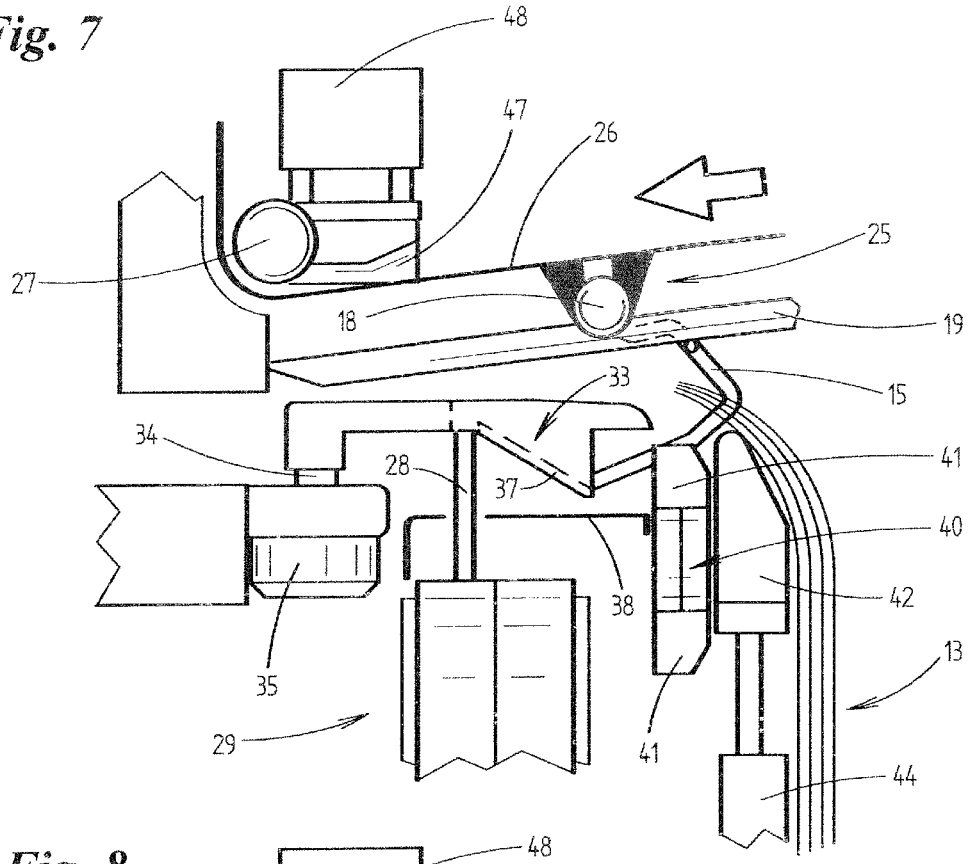
Figure 8:
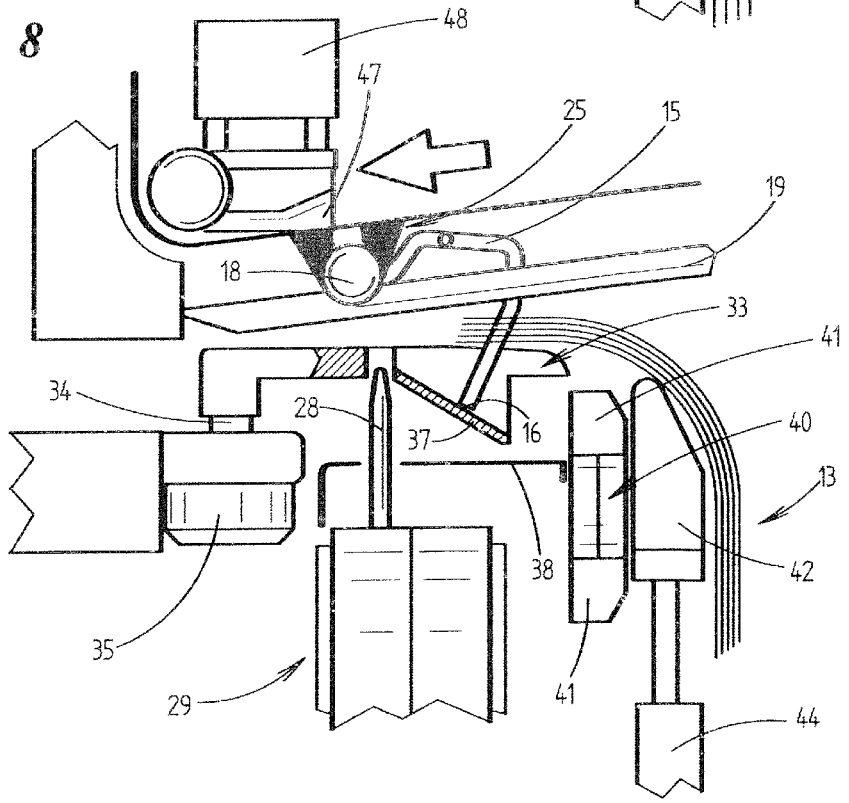
Figure 9:
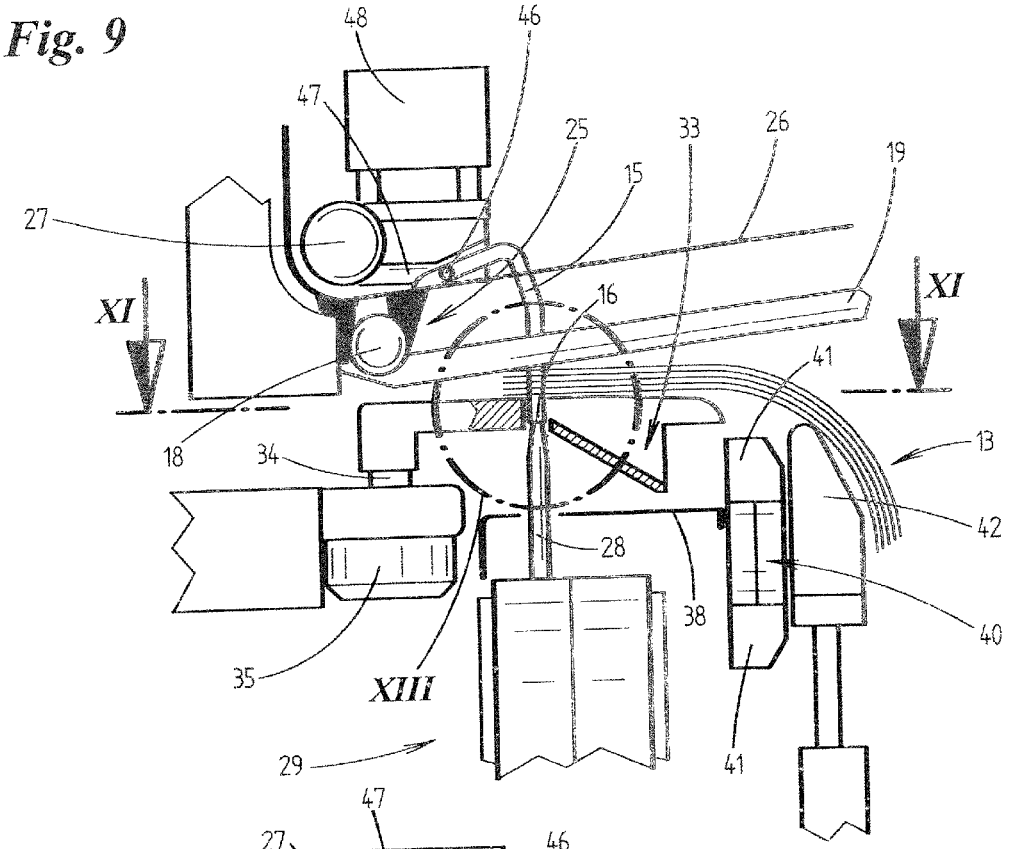

As a further special characteristic, provision is made for the bag carriers 15 to be rotated about the spindle 17 of the carriage 20 in order for the free end 16 of the bag carriers 15 to be placed above, or on, the receiving pins 28. For this purpose, groove-like depressions 36 are formed in the pivoting arms 33. On the one hand, the depressions 36 serve for guiding the bag carriers 15. On the other hand, the depressions 36 have an inclined base 37, which slopes up in the direction of the receiving pins 28. As FIGS. 7 to 9 show, the free end 16 of the bag carriers 15 comes into contact with the base 37 of the depression 36 and is guided along the upwardly sloping base 37, as a result of which the bag carrier 15 is rotated, during transportation in the conveying direction, until the free end 16 of the same is oriented downward and rests on a receiving pin 28.

By virtue of the pivoting arm 33 being pivoted out of the region above the conveying device 29, the bags 10 of the bundle 13 can drop onto the receiving pins 28. The bags 10 then rest on a horizontal transporting path 38, which is arranged at a distance above the conveying device 29 and along which the bags 10 are transported in the conveying direction of the conveying device 29. The transporting path 38 has a longitudinal slot 39, through which the receiving pins 28 pass in order to accommodate the bags 10. The longitudinal slot 39 runs parallel to the conveying direction on the conveying device 29.

The bags 10 are transported, on the one hand, by the receiving pins 28, which can be moved in the conveying direction via the conveying device 29. Also provided is a further conveying means 40 to the side of the transporting path 38, it being possible for said further conveying means to be an endless conveyor with drivers 41 arranged on the circumference of the conveyor belt. The conveying means 40 is driven synchronously with the conveying device 29, wherein the drivers 41 are oriented such that they butt in each case against a side edge of the bags 10 which is directed transversely to the conveying direction. This means that the bundle of bags 10 is moved in the conveying direction not just in the region of the suspension holes 12, but also at a distance therefrom, in the vicinity of the underside of the bags 10. This can prevent the bags 10 from becoming skewed during transportation along the transporting path 38.

A further measure to ensure that the bags 10 are fed, as far as possible, without any folds being formed resides in the arrangement of a mechanism for smoothing the bags 10. A ramp 42 with an obliquely directed or upwardly sloping front side is provided in this case. During the feeding operation, the bundles 13 of bags 10 are drawn over the ramp 42 and are smoothed in the process (FIGS. 7 to 9).

Figure 10:
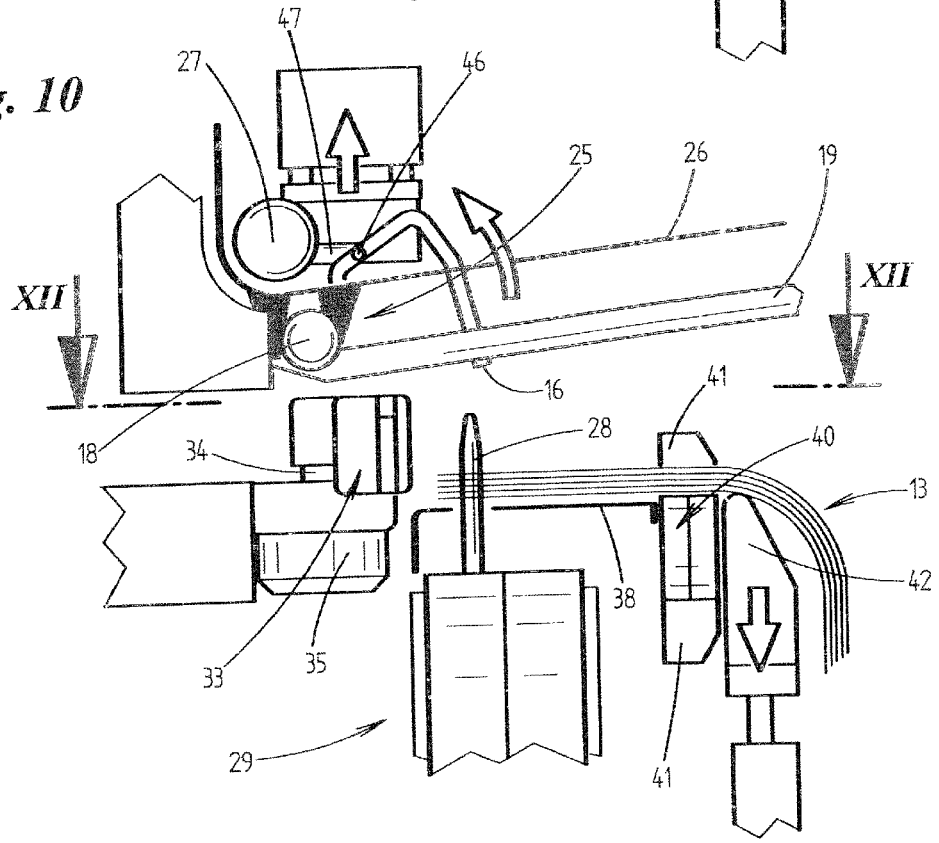
Figure 11:
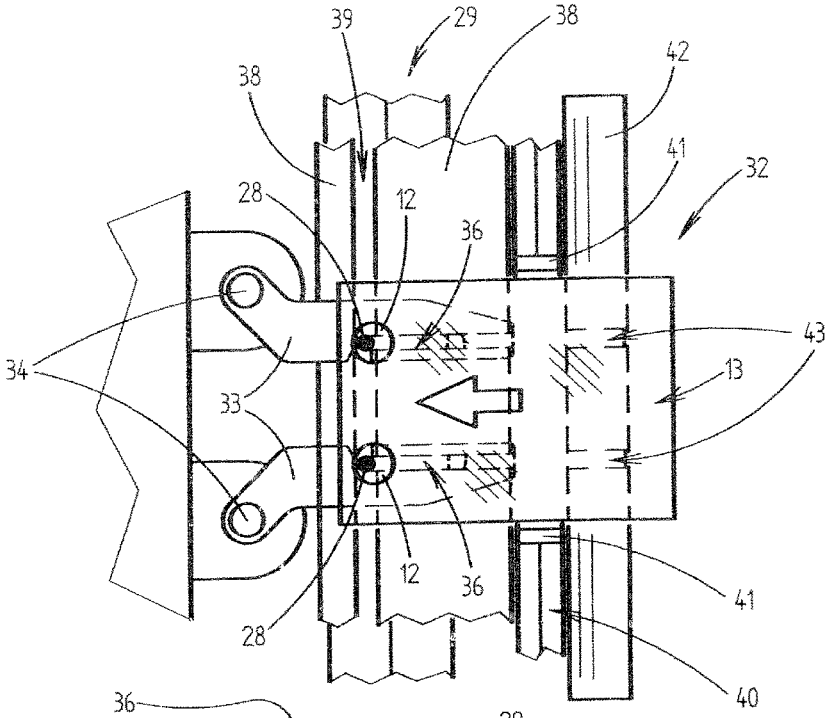
FIG. 11 shows a horizontal section along section line XI-XI in FIG. 9.
Figure 12:
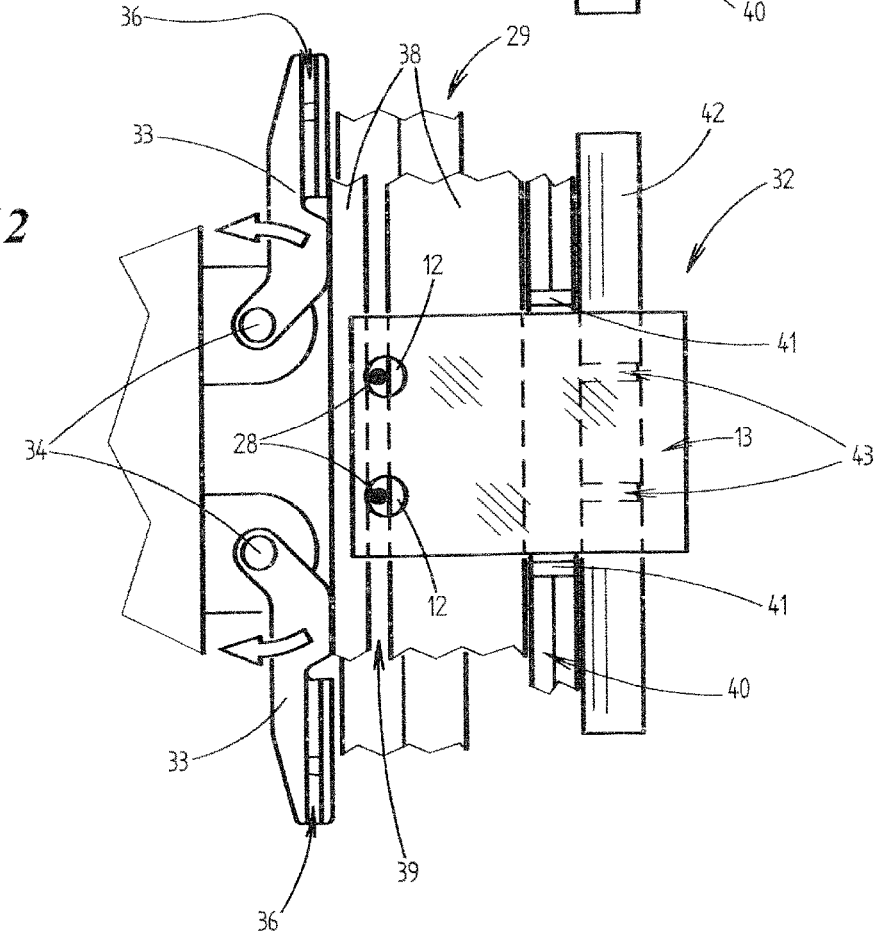
FIG. 12 shows a horizontal section along section line XII-XII in FIG. 10.

Following transfer of the bundles 13 to the receiving pins 28, the ramp 42 can be lowered in the vertical direction in order not to stand in the way of the bags 10 being transported away (FIG. 10). The ramp 42 preferably also has depressions 43, in order to guide the bag carriers 15. A pneumatic cylinder 44 or a correspondingly suitable mechanism may be provided for moving the ramp 42 in the vertical direction.

Figure 13:
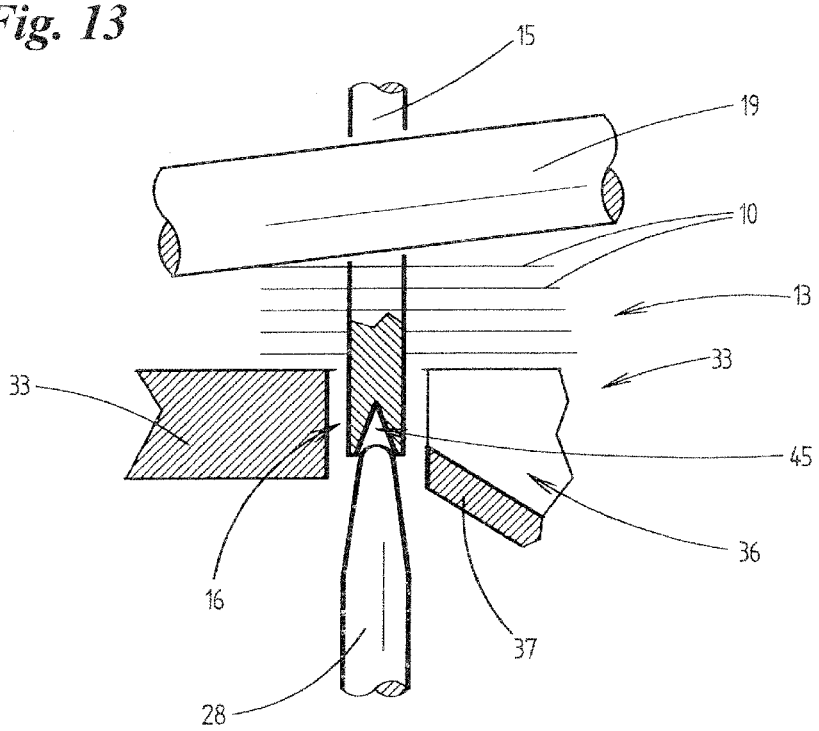
FIG. 13 shows a detail in the region XIII in FIG. 9.
Figure 14:
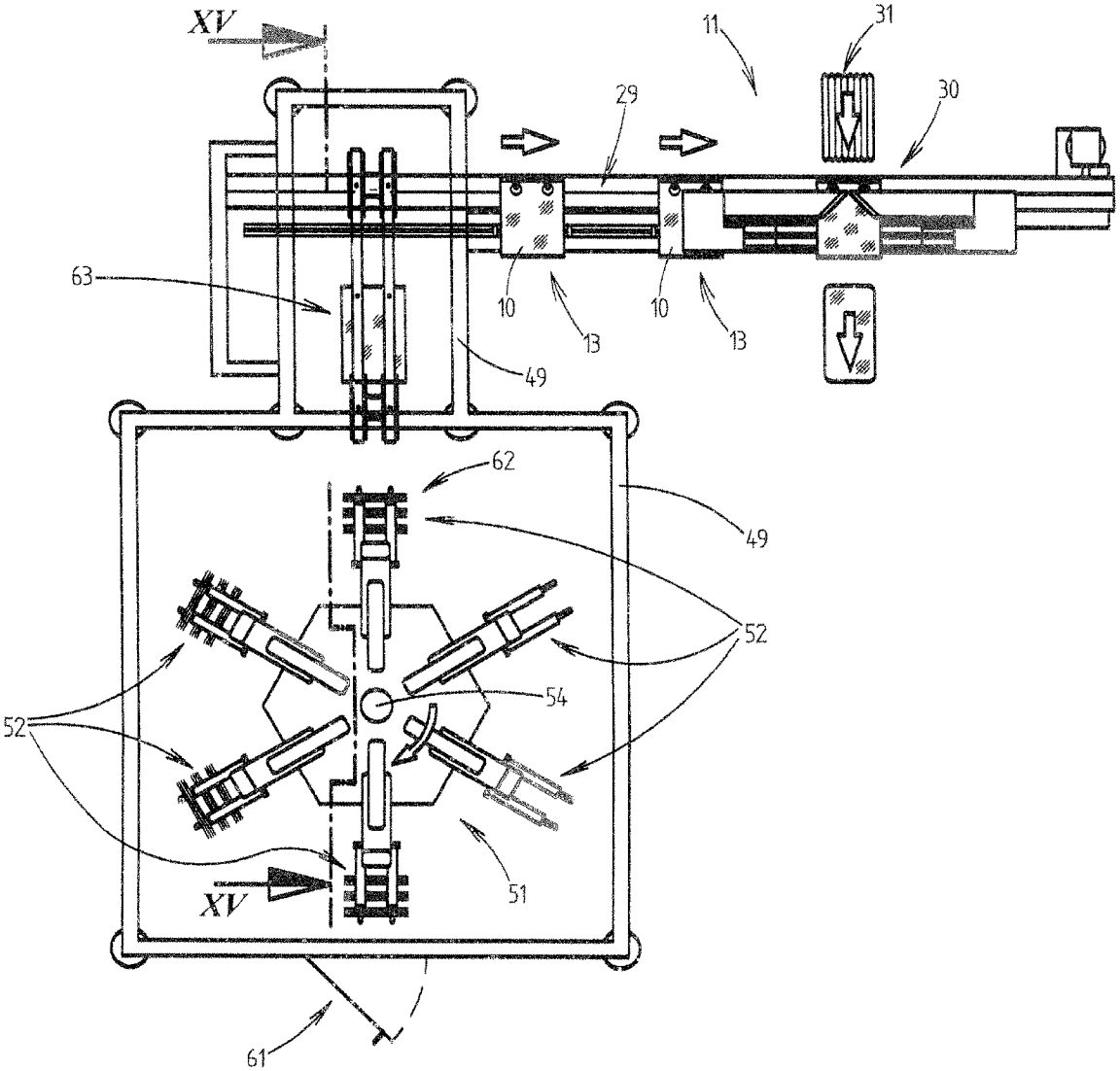
FIG. 14 shows a plan view of a packaging machine with an upstream magazine for bags (2nd exemplary embodiment)
Figure 15:
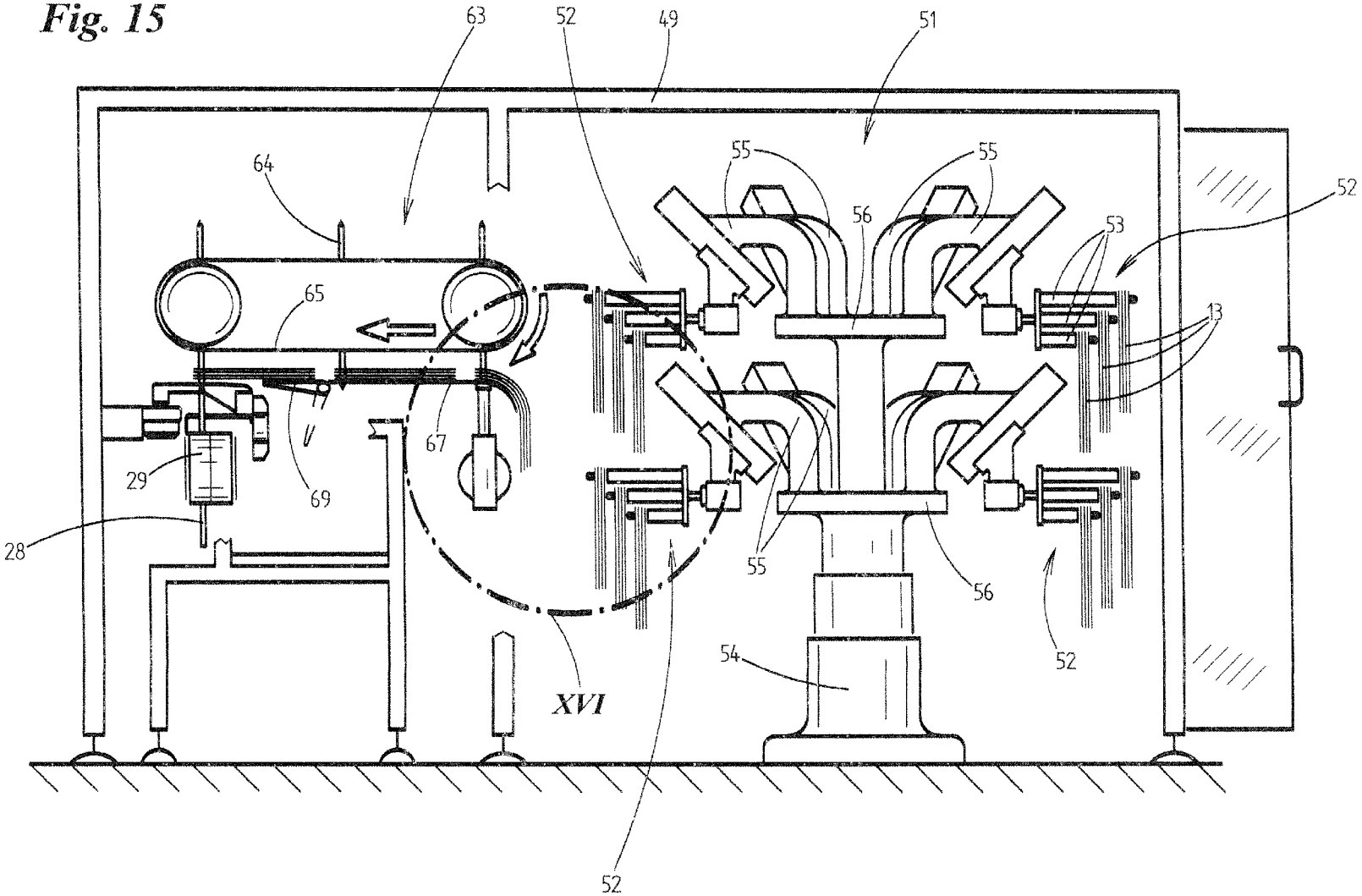
FIG. 15 shows a vertical section taken through the apparatus according to FIG. 14 along section line XV-XV in FIG. 14, and FIGS. 16 and 17 show, in an enlarged illustration, a detail of the apparatus in the region XVI in FIG. 15 during different phases of the feeding operation of the bags.

FIG. 13 shows a further beneficial detail of the apparatus. Accordingly, the free end of the receiving pins 28 is pointed and can be positioned in a form-fitting manner in an end-side recess 45 in the region of a free end 16 of the bag carriers 15. This provides for reliable positioning of the free ends 16 of the bag carriers 15 on the receiving pins 28 and thus for straightforward transfer of the bags.

Once the bags 10 have been transferred to the receiving pins 28 of the conveying device 29, the bag carriers 15 are raised in order to allow the bags 10 to be transported away from the feeding station 32. The raising action is brought about, in the present case, in that laterally projecting pins 46 are fitted on the bag carriers 15, said pins engaging in a guide track 47 during the operation of feeding the bag carriers 15 into the transfer position. By virtue of the guide track 47 being raised by means of a lifting cylinder 48 (FIG. 10), the free end 16 of the bag carriers 15 is lifted off from the receiving pins 28 and the bag carriers 15 are pivoted slightly about the spindle 17 in the process.

Following the raising operation of the bag carriers 15, the latter are conveyed by the drivers 25 along an upright conveying strand of the driver chain 26 and, in the region of an upper deflecting roller 27, are transferred to a further pair of running rails 19. The running rails 19 are inclined in the direction of the magazine 14, and therefore the carriages 20 are moved back to the magazine 14 by gravitational force. As an alternative, it is conceivable for the bag carriers 15 or the carriages 20, following transfer of the bags 10, to be conveyed away and transferred to a delivery means, which loads the bag carriers 15 anew with a bundle 13 of bags 10.

Figure 2:
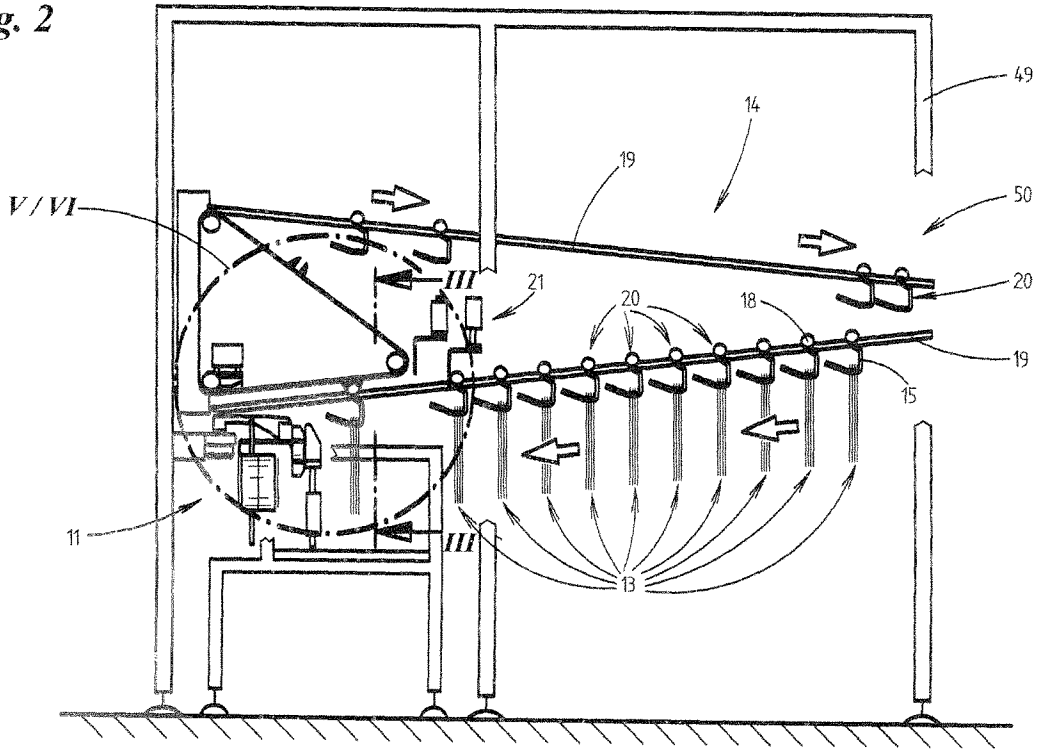
FIG. 2 shows a side view corresponding to arrow II in FIG. 1.

As in the present case, a protective framework 49 may be provided in the region of the magazine 14 and of the feeding station 32 in order to avoid, in particular, unintended intervention in the feeding operation of the bags 10. FIG. 2 indicates a kind of window 50 in the protective framework 49. This window can serve for feeding the carriages 20 with bundles 13 to the magazine 14 and for receiving possibly empty carriages 20 from the process in order to be refilled.

The only essential difference between the second exemplary embodiment according to FIGS. 14 to 17 and the first exemplary embodiment is that the second exemplary embodiment makes use of a different magazine 51. A description will therefore be given only of those parts of the apparatus which are designed in a different manner than in the first exemplary embodiment.

The magazine 51, in the present case, is designed in the manner of a carousel, with bag mounts 52 arranged in a plurality of planes.

Each bag mount 52, in the present case, has a plurality of bag holders 53. The bag holders 53 are arranged one above the other in pairs in a plurality of planes and serve for receiving a respective bundle 13 of bags 10.

In the present case, the bag holders 53 are positioned in each case in pairs in three planes arranged one above the other, and therefore three bundles 13 of bags 10 can be accommodated on each bag mount 52. Of course, the number of planes can vary. It is also conceivable, in particular, to have bag mounts 52 with a larger or a smaller number of bag holders 53.

In each plane of the carousel-like magazine 51, the bag mounts 52 are arranged on carrying arms 55 directed radially in relation to a central spindle 54. In the present case, six carrying arms 55 are positioned in each plane of the magazine 51. Of course, the number of carrying arms 55 in each plane can vary. It is also conceivable, in particular, to have planes with a larger or a smaller number of carrying arms 55.

In the exemplary embodiment shown, the carousel-like magazine 51 has two planes with carrying arms 55. It is also conceivable here, however, to have a larger or smaller number of planes, for example just one plane or three or more planes.

The carrying arms 55 of a plane are connected to a common carrying plate 56, said carrying arms being rotatable around the upright or vertical spindle 54. Furthermore individual elements of the spindle 54 are telescopic in the vertical direction, and therefore the carrying plates 56 or the carrying arms 55 and finally the bag mounts 52 can be positioned in the vertical direction with the bundles 13 located thereon.

Figure 16:
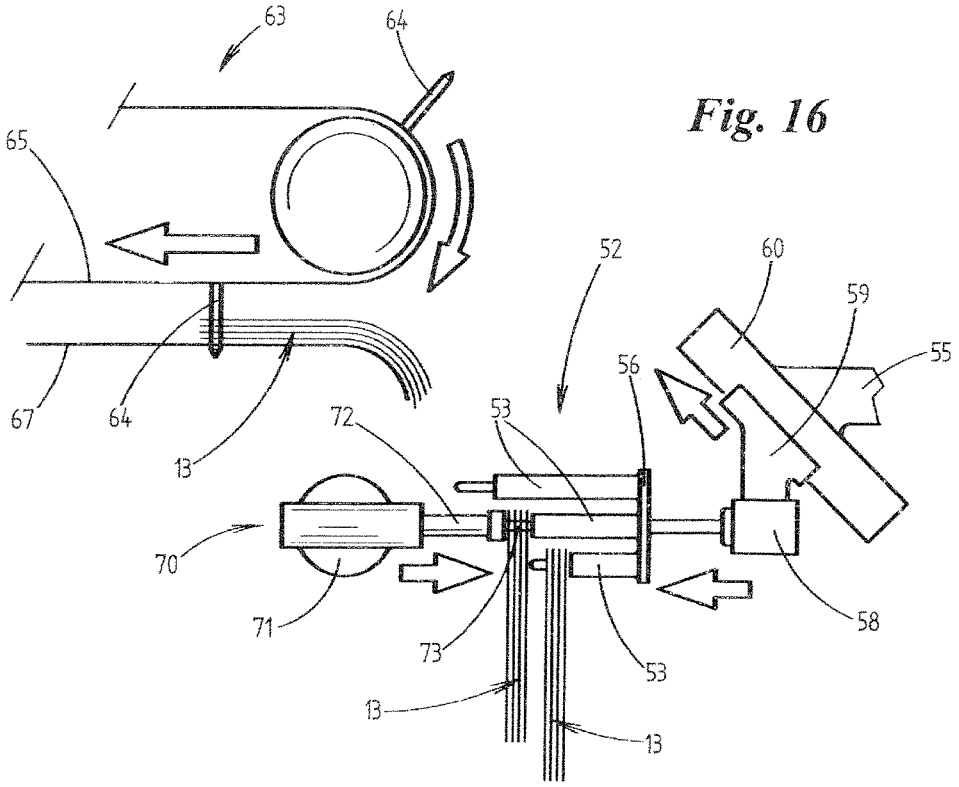
Figure 17:
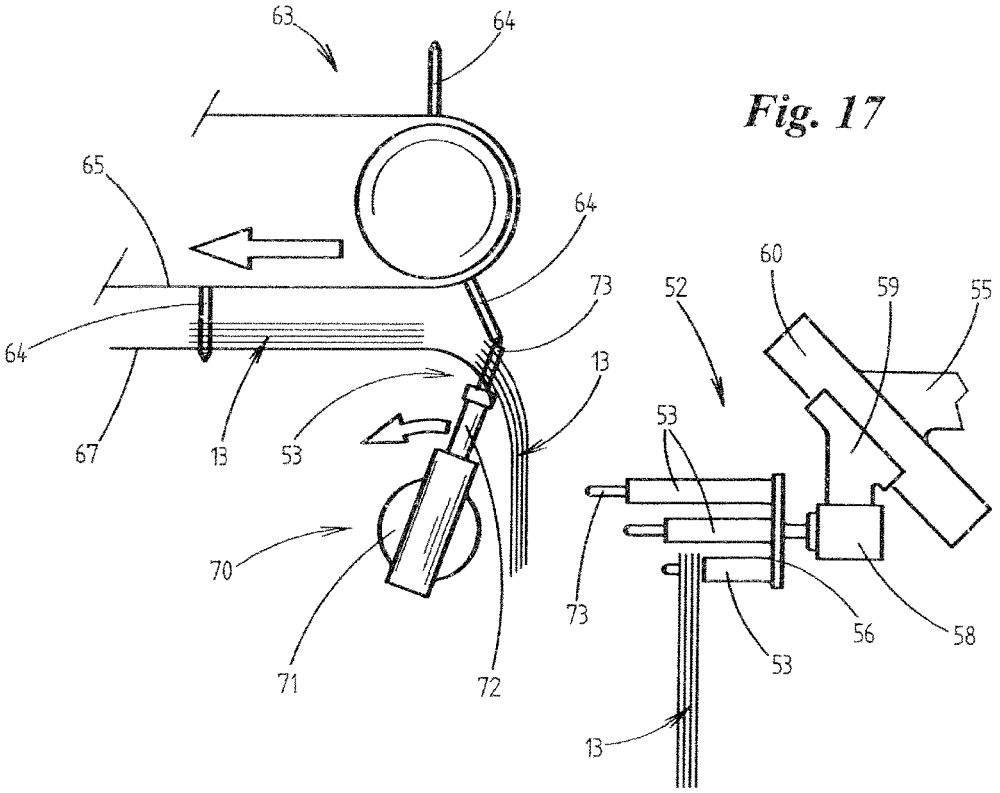

A further special characteristic is shown in FIGS. 16 and 17. The bag holders 53 of the three planes are mounted on a common carrying plate 57. The carrying plate 57, in turn, is connected to a pneumatic cylinder 58, which is arranged on a displacement slide 59. The displacement slide 59 itself is mounted such that it can be displaced on an obliquely directed end portion 60 of the carrying arms 55. This allows the carrying arms 55 to be positioned in the vertical and horizontal directions in order to transfer the bundles 13.

As in the first exemplary embodiment, the magazine 51 is enclosed by a protective framework 49. A door 61 is provided on one side, so that bags 10 can be added to the magazine 51.

The magazine 51, which has had its essential parts described thus far, functions as follows: the bags 10 are fed to the bag holders 53 in bundles 13 by an operator in the region of the door 61. The magazine 51 is then rotated further by one position, and therefore the next bag holders 53 are positioned in the region of the door 61. Opposite the door 61, in the region of which a feeding station is located, is a transfer station 62, in the region of which the bags 10 are transferred to an adjoining feeding conveyor 63.

The feeding conveyor 63 serves for feeding the bundles 13 to the conveying device 29. For this purpose, the feeding conveyor 63 has receiving pins 64 for the bundles 13. The receiving pins 64 of the feeding conveyor 63, at the end of the latter, are positioned, in a manner analogous to the illustration according to FIG. 13, above the receiving pins 64 of the conveying device 29 in order for the bundles 13 to be transferred. In the present case, the feeding conveyor 63 is designed in the form of a continuously driven endless conveyor, on the conveying strands of which are arranged, in an outwardly projecting manner, the receiving pins 64 for engaging in these suspension holes 12 of the bags 10. The receiving pins 64 are arranged one beside the other in pairs, wherein the pairs of receiving pins 64 are spaced apart from one another in the conveying direction of the feeding conveyor 63. The bundles 13 are transported in the conveying direction, according to arrow 66, by means of the receiving pins 64 in the region of a lower strand 65 of the feeding conveyor 63. The flat-lying bundles 13 here rest on a transporting path 67. The transporting path 67 contains apertures 68 which run in the longitudinal direction of the transporting path and through which the ends of the receiving pins 64 pass.

The end of the transporting path 67 is provided with a pivotable flap 69, which can be pivoted following transfer of the bundles 13 to the receiving pins 28 of the conveying device 29, and therefore the rear ends of the bundles 13, as seen in the transporting direction, drop. The bundles 13 are transported further in the manner described in the introduction.

A transfer device 70 is provided in order to transfer the bundles 13 from the bag mounts 52 to the feeding conveyor 63, said transfer device being positioned between the magazine 51 and the adjoining feeding conveyor 63. The transfer device 17 has a pair of bag holders 53, which are mounted so as to be pivotable, on the one hand, and telescopic, on the other. A pivoting drive 71 is provided in order to pivot the bag holders 53, said pivoting drive being combined with a telescopic drive 72 for telescoping the bag holders 53.

The bundles 13 are transferred from the magazine 51 to the feeding conveyor 63 such that, in the first instance, the bag holders 53 of the magazine 51 are positioned in alignment with the bag holders 53 of the transfer device 70 (FIG. 16). The bundles 13 are transferred here to the transfer device 70. The transfer device 70 is then pivoted, and therefore the bundles 13 can be received by the receiving pins 64 of the feeding conveyor 63. The transfer device 70 is then pivoted back in order to accommodate the next bundle 13. Use of the pneumatic cylinder 58 and of the displacement slide 59 bring said bundle 13 in good time into a position which is appropriate for transfer purposes.

Once all the bundles 13 have been transferred to a carrying arm 55, either the bundles can be transferred from a carrying arm 55 of a different plane or the carrying arms 55 are rotated by one position, and therefore bundles continue to be removed from the same plane and it is only once all the bundles 13 of one plane have been removed that bundles are removed from a different plane.

As FIG. 17 shows, the transfer device 70 can feed the bundles 13 above the transporting path 67. In the present case, a free end of the transporting path 67 is rounded in the direction of the transfer device 70 so as to facilitate this measure.

The operation of receiving the bundles 13 on the bag holders 53 from the bag mounts 52 of the magazine 71 can take place in various ways. A variant is shown in the drawing. In this case, the bag holders 53 of the magazine 51 and of the transfer device 70 each have, at their free end, a pin 73, which grips through the suspension holes 12. The pins 73 of the bag holder 53 of the magazine 51, in the present case, can be pushed into a housing of the bag holders 53 counter to the action of a spring, and therefore the bundles 13 are transferred to the fixed pins 73 of the bag holders 53 of the transfer device 70 when these are pushed in the direction of the bag holders 53 of the magazine 51 by the telescopic drive 72.

LIST OF DESIGNATIONS

10 Bag
11 Packaging machine
12 Suspension hole
13 Bundle
14 Magazine
15 Bag carrier
16 Free end (bag carrier)
17 Spindle
18 Roller
19 Running rail
20 Carriage
21 Separating device
22 Retaining means
23 Retaining means
24 Pneumatic cylinder
25 Driver
26 Driver chain
27 Deflecting roller
28 Receiving pin
29 Conveying device
30 Filling station
31 Product
32 Feeding station
33 Pivoting arm
34 Spindle
35 Rotary cylinder
36 Depression
37 Base
38 Transporting path
39 Longitudinal slot
40 Conveying means
41 Driver
42 Ramp
43 Depression
44 Pneumatic cylinder
45 Recess
46 Pin
47 Guide track
48 Lifting cylinder
49 Protective framework
50 Window
51 Magazine
52 Bag mount
53 Bag holder
54 Spindle
55 Carrying arm
56 Carrying plate
57 Carrying plate
58 Pneumatic cylinder
59 Displacement slide
60 End portion
61 Door
62 Transfer station
63 Feeding conveyor
64 Receiving pins
65 Lower strand
66 Arrow
67 Transporting path
68 Aperture
69 Flap
70 Transfer device
71 Pivoting drive
72 Telescopic drive
73 Pin

What is claimed is:

1. An apparatus for handling bags, in particular wicketed bags, combined into bundles and for feeding the bags to a packaging machine, comprising:

a) a magazine upstream of the packaging machine for supplying the bags in a plurality of bundles to the packaging machine;

b) bag carriers on which the bundles are arranged such that the bag carriers extend through suspension holes of the bags, wherein the bag carriers with the bags located thereon are configured to be fed from the magazine to the packaging machine; and c) a cyclically driven connecting device of the packaging machine, the cyclically drive connecting device comprising receiving pins, wherein the bundles are configured to be transferred from the bag carriers directly to the receiving pins of the cyclically driven conveying device of the packaging machine in order for the bags to be filled in the packaging machine, wherein the bag carriers are configured to be moved in the conveying direction in the region of the conveying device by drivers of a driver chain, wherein the drivers act on a spindle, alongside guide means.

2. An apparatus for handling bags, in particular wicketed bags, combined into bundles and for feeding the bags to a packaging machine, comprising:

a) a magazine upstream of the packaging machine for supplying the bags in a plurality of bundles to the packaging machine;

b) bag carriers on which the bundles are arranged such that the bag carriers extend through suspension holes of the bags, wherein the bag carriers with the bags located thereon are configured to be fed from the magazine to the packaging machine; and c) a cyclically driven connecting device of the packaging machine, the cyclically drive connecting device comprising receiving pins, wherein the bundles are configured to be transferred from the bag carriers directly to the receiving pins of the cyclically driven conveying device of the packaging machine in order for the bags to be filled in the packaging machine, wherein free ends of the bag carriers and corresponding free ends of the receiving pins are configured for form-fitting engagement in relation to one another, such that the free ends of the bag carriers have an end-side recess in which the free ends of the receiving pins are configured to engage, wherein the receiving pins have a cross section which decreases in the direction of the free ends, in order to engage in the end-side recess.

3. An apparatus for handling bags, in particular wicketed bags, combined into bundles and for feeding the bags to a packaging machine, comprising:

a) a magazine upstream of the packaging machine for supplying the bags in a plurality of bundles to the packaging machine;

b) bag carriers on which the bundles are arranged such that the bag carriers extend through suspension holes of the bags, wherein the bag carriers with the bags located thereon are configured to be fed from the magazine to the packaging machine; and c) a cyclically driven connecting device of the packaging machine, the cyclically drive connecting device comprising receiving pins, wherein the bundles are configured to be transferred from the bag carriers directly to the receiving pins of the cyclically driven conveying device of the packaging machine in order for the bags to be filled in the packaging machine, wherein the conveying device has a driver belt for transporting the bundles in a transverse direction in particular in a horizontal plane, wherein the driver belt has spaced-apart receiving pins for engaging in the suspension holes of the bags, and wherein at least one supporting means comprising two pivoting arms is arranged in the conveying path of the bundles, above the receiving pins, the bundles resting on the supporting means prior to being transferred to the receiving pins, the supporting means, following the feeding operation of a bundle, being movable out of the region of the receiving pins in order for the bundles to be transferred to the receiving pins, wherein for a ramp mechanism is arranged upstream of the supporting means and in the conveying path of the bundles, and wherein the bundles on the bag carriers are configured to be conveyed in a hanging state in the direction of the receiving pins, the bags being smoothed in the process by temporary abutment against the ramp mechanism.

4. A method for handling bags, in particular wicketed bags, combined into bundles and for feeding the bags to a packaging machine, comprising the steps of:

a) supplying the bags in a plurality of bundles in a magazine upstream of the packaging machine;

b) arranging the bundles on bag carriers such that the bag carriers extend through suspension holes of the bags;

c) feeding the bag carriers with the bags located thereon from the magazine to the packaging machine; and d) transferring the bundles from the bag carriers directly to corresponding receiving pins of a cyclically driven conveying device of the packaging machine and then filling the bags in the packaging machine, wherein the bag carriers are configured to be displaced along guide means, namely running rails, wherein the guide means are inclined, at least in certain regions, in the direction of the packaging machine, and therefore the bag carriers with the bags are moved by gravitational force along the guide means in the direction of the packaging machine, wherein the bag carriers, at least in the region of the conveying device, are moved along the guide means in the direction of the receiving pins by a conveying mechanism, namely a driver chain, and are positioned appropriately above the pins in order for the bundles to be transferred, wherein the bag carriers, in the region of the gravitational-force conveying operation, are arranged and/or transported essentially in a close-packed manner, and wherein the bundles are then separated from others of the bundles and are transported at a distance apart from one another by the conveying mechanism, namely by drivers of the driver chain.

5. The method as claimed in claim 4, further comprising smoothing the bags prior to transferring the bags to the receiving pins of the conveying device by drawing the bundles on the bag carriers or on the receiving pins of the feed conveyor in a hanging state over a ramp mechanism located in the conveying path of the bags, wherein the bag carriers or the receiving pins have a free end positioned on an upper, free end of the upright receiving pins, wherein the underside of the bags rests on at least one supporting means, in the form of two pivoting arms, arranged in the conveying path of the bags, wherein the at least one supporting means is moved out of the region of the bags in order for the bags to be transferred to the receiving pins, by virtue of the pivoting arms being pivoted laterally, and wherein the free ends of the bag carriers or receiving pins are guided in groove-like depressions of the pivoting arms and/or of the ramp, during the feeding operation to the receiving pins, and the bag carriers are rotated gradually in the groove-like depressions, by abutment against the guides, such that, when the receiving pins are reached, the free ends of the bag carriers are oriented downward and run essentially in alignment with the free ends of the receiving pins.

* * * * *